US007963411B2

(12) United States Patent
Nölle

(10) Patent No.: US 7,963,411 B2
(45) Date of Patent: Jun. 21, 2011

(54) CONTAINER WITH A LOCK

(76) Inventor: Jürgen Nölle, Rheinberg (DE)

( * ) Notice: Subject to any disclaimer, the term of this patent is extended or adjusted under 35 U.S.C. 154(b) by 1227 days.

(21) Appl. No.: 10/566,609

(22) PCT Filed: Jul. 30, 2004

(86) PCT No.: PCT/DE2004/001725

§ 371 (c)(1),
(2), (4) Date: Jan. 31, 2006

(87) PCT Pub. No.: WO2005/012117

PCT Pub. Date: Feb. 10, 2005

(65) Prior Publication Data

US 2006/0243628 A1 Nov. 2, 2006

(30) Foreign Application Priority Data

Aug. 1, 2003 (DE) ..... 203 12 174 U

(51) Int. Cl.
*A47G 19/00* (2006.01)
*B65D 21/02* (2006.01)
*B65D 21/00* (2006.01)

(52) U.S. Cl. ..... 220/23.4; 220/23.8; 206/504

(58) Field of Classification Search ..... 220/23.4, 220/23.8; 206/504, 505, 457; 215/296
See application file for complete search history.

(56) References Cited

U.S. PATENT DOCUMENTS

| | | | | |
|---|---|---|---|---|
| 1,499,603 | A | 4/1874 | Weston | |
| 3,194,426 | A * | 7/1965 | Brown, Jr. | 220/23.4 |
| 3,994,408 | A * | 11/1976 | Belitzky | 215/10 |
| 4,169,493 | A * | 10/1979 | Segalowicz | 383/96 |
| 4,624,383 | A * | 11/1986 | Moore | 220/23.4 |
| 5,833,465 | A * | 11/1998 | Jarzewiak | 434/171 |

FOREIGN PATENT DOCUMENTS

| | | |
|---|---|---|
| DE | 2 239 337 | 3/1974 |
| DE | G8622192.2 | 11/1986 |
| DE | 88 07 193.6 | 9/1988 |
| DE | 3804275 | 8/1989 |
| DE | 195 17 460 A1 | 11/1996 |
| DE | 197 30 248 A1 | 1/1999 |
| EP | 518252 | 12/1992 |
| NL | 9301506 | 4/1995 |
| WO | WO 2004/033329 A1 | 4/2004 |

* cited by examiner

*Primary Examiner* — Anthony Stashick
*Assistant Examiner* — Shawn M Braden
(74) *Attorney, Agent, or Firm* — Collard & Roe, P.C.

(57) ABSTRACT

The invention relates to a container (1), which is provided with a lock, can be filled with a liquid and is positively connectable with at least one another container (1). In order to form an assembly of several containers (1), the invention is characterized in that the containers (1) are provided with at least one flat surface, several containers can be assembled according to a two-dimensional interconnection, and a form fit is obtainable with at least one adjacent container, at least one first form (2, 5) projected with respect to the base form of the container (1), is engageable into at least one second corresponding form embedded in the base form of the container (1), and extends at least to one surface thereof.

22 Claims, 3 Drawing Sheets

CONTAINER WITH A LOCK

CROSS REFERENCE TO RELATED APPLICATIONS

Applicant claims priority under 35 U.S.C. §119 of German Application No. 20312174.0 filed Aug. 1, 2003. Applicant also claims priority under 35 U.S.C. §365 of PCT/DE2004/001725 filed Jul. 30, 2004. The international application under PCT article 21(2) was not published in English.

The invention relates to a container with a lock that can be filled with a liquid and positively connected with at least one other container.

Various solutions are available for storing objects, liquids or bulk materials in containers, whereby some of the existing containers can be stacked due to their external shape, forming a three-dimensional composite in that way. In most cases, such three-dimensional stackable containers are shaped for space and safety reasons in such a way that they can safely stand upright as a composite, on the one hand, and set up safely in a space-saving manner on the other. The esthetic aspects of such a container are generally rarely taken into account when such storage containers are designed. In the foreground of design considerations are capability for easy stacking, safety, and versatility of the stacked composite.

In addition to storage containers that can be positively connected with each other and stacked, positively connectable containers are known as well that are intended for safely storing small objects in order to hide the latter in sweets. For example, the patent documents U.S. Pat. No. 1,499,603, German utility model G 8622192.2 and European patent EP 518252 disclose resealable, three-dimensional storage containers that can be plugged into one another with plug mechanisms with little external esthetic appeal, and are intended for storing small toy items in such containers, so that such toys are protected from chocolate and can be marketed in chocolate eggs.

German patent specification DE 3804275 discloses a three-dimensional stackable cup for storing dairy products that is similar to a toy building brick for children.

Furthermore, laid-open patent specification DE-OS 2239337 discloses a drinking game that consists of a bottle in the form of a dice, whereby a raised screw closure is attached to one of the six sides of the dice. In addition to the screw closure, the bottle has a central receiving deepening on each of the five remaining sides, said deepening being capable of precisely positively receiving the closure of another bottle having the same structure. Thus only one interconnection is possible in the form of a chain. In addition to the raised screw closure and the five receiving recesses, the dice-shaped bottle has a small, three-cornered flattening on each of the eight corners of the dice-like form, such flattening serving as a connecting means. Of said eight three-cornered flattenings, four flattenings support a small lug, whereas the four other flattenings each have a corresponding hole, so that said bottle can be stacked only with the help of said connecting elements in the way of cubic space centering. Furthermore, connecting means disposed on the edges permit the bottles to be connected among one another diagonally, permitting a chessboard-like coverage of the surface area.

By plugging two structurally identical bottles of the same type together with the help of the lock as a lug and one of the receiving recesses disposed on the five sides of the dice, it is possible to stack the bottles one-dimensionally in a cubic manner. By selecting one of the five sides with a receiving deepening, it is possible also to plug the bottles one into another in such a way that they form a chain angled off by 90°.

By plugging the bottles together corner to corner in any space direction with cubic, space-centered stacking capability, it is possible to produce complicated three-dimensional structures of said bottles. However, none of the connection possibilities disclosed in said laid-open patent specification permits obtaining an intimate composite with a fully covered surface area.

One serious drawback of the bottles specified above is that the interconnection between the screw closure and the central receiving deepening acts like a lever that can very easily open the screw closure at least in part with only minor agitation of the not very stable composite if the latter is formed by a screw closure and a central receiving deepening. This may undesirably permit liquid to leak from the bottle.

Some users of specially shaped bottles, apart from appreciating their functionality, have a need for collecting such containers, or for complementing other containers of the same type, and/or for decorating such containers in a representative way, if deemed desirable.

Because of the not very appealing shape of the bottles disclosed in the laid-open patent cited above, such bottles are only conditionally suited as collector's items.

Therefore, the present invention is based on the problem of providing a container that forms an intimate and self-stabilizing composite with full coverage of the surface area.

Another problem of the invention consists in providing a container which, in its stacked condition, makes available a surface area where instructions, information, or esthetic, two-dimensionally sculptured creations can be displayed.

According to the invention, the problem is resolved in that the container has at least one plane surface, and several containers can be assembled to form a two-dimensional composite, and a positive connection can be produced with at least one adjacent container, whereby at least one form protruding vis-à-vis the basic contour of the container engages at least one second corresponding form projecting into the basic form of the container, thereby extending into at least one surface of the container.

The containers as defined by the invention are primarily designed for assembly in the form of a two-dimensional composite comprising a number of containers. For said purpose, it is necessary to produce a positive connection with at least one adjacent container, which assures that the containers are not torn from the composite structure, for example not even if any displacement should occur. For said purpose, provision is made for at least one first form protruding versus the basic contour of the container, said form engaging at least one corresponding form projecting into the basic form of the container, extending at least into a surface of the container. It is assured by means of said measure, for example that an individual container placed on a table with its plane surface, can be assembled to form a composite by adding further containers to it. For said purpose, the two corresponding forms have shapes that are almost coinciding, so that they can be placed one into another, taking into account the required tolerances and minor play of movement, so that the protruding form is basically slightly smaller than the form protruding into the container. Furthermore, the forms extend into the surface of the container, so that one container can be placed onto the other from the top. In the individual case, the form may occupy the entire depth of the container, so that the added container including its form is terminated flush with the lower and upper surfaces.

Owing to the fact that at least one, preferably two parallel flat surfaces are formed, it is possible to stack several layers of containers one on top of the other. Owing to the interconnection between at least two containers, preferably of more containers arranged one next to the other, an intimate composite is formed that is maintained, for example even if a center container is removed from the composite, and, furthermore, containers disposed on the edge sides are supported by the directly adjacent containers, and thus prevented from dropping out of the composite. Therefore, it is possible in this way to arrange as many containers as possible with high packing density in a space-saving manner. With a preferably flat design of the containers, it is possible, furthermore, to assure that the containers are prevented from turning and disarrangement during transport, so that such a composite is advantageously suited for imprinting it with an attractive motif.

In a particularly preferred embodiment of the invention, provision is made that each container is interconnected with each adjacent container by a positive connection, so that such a component has high stability. The container preferably forms jointly with the other, identically structured containers a regular pattern that does not need to be compatible, for example with any imprinted pattern. In a preferred embodiment, the surfaces of the containers positively connected with one another and fully and intimately covering each other with their surfaces, are plane. A plane surface formed by a plurality of the containers as defined by the invention has the advantage that as part of the composite, it can pass through a printing machine, so that large poster images or information can be imprinted on such containers in large surface areas, whereby the containers in the composite structure cannot be displaced against one another in the printing process. Such containers as defined by the invention can be mechanically separated again in a subsequent separation step. It is assured in this manner that a motif, pattern, information, notes, or instructions imprinted on or glued to the composite will not have any joints when the latter is assembled, such joints being attributable to uneven imprinting or tolerances in the positioning of the containers.

In another preferred embodiment, at least one projection of at least one circumference is similar to a piece of a puzzle. The term "puzzle" in the context of the present invention means that the container has four sides, of which two sides have a concave form directed inwards, and two sides have a convex form directed outwards. The outwardly directed, convex forms of the container positively engage the concave, inwardly directed forms of another container having the same shape. By suitably selecting the shape of a piece of a puzzle thus permits connecting of the containers with one another with full coverage of their surface areas and in a positive manner, so that such containers form a solid composite that cannot be torn apart. Other puzzle geometries are feasible as well in addition to a binary geometry. For increasing their stacking capability, provision is made that the containers have two parallel surfaces, one surface for laying the container down, and the other for imprinting it.

The special advantage of such an embodiment is that a number of containers of the same type plugged together form a composite with no mobility of the containers vis-à-vis one another without requiring any additional fastening means. This particularly makes it possible to transport several containers through a printing machine, where the containers are jointly imprinted. A further benefit is that users of such a packaging means can more easily recognize the purpose of the positively conditioned shape on account of the way it is designed.

In a further embodiment, the container is similar to components that can be plugged one into another. Said embodiment is advantageous in that the positive interconnection can be recognized, and the design as defined by the invention can be easily recognized as a means for forming a composite of resealable containers as defined by the invention.

According to a further developed embodiment of the invention, provision is made that the first form is molded onto the basic form of the container, forming one piece jointly with the latter, and has two irregularly shaped, parallel surfaces that are provided with a constriction. On the other hand, the second form consists of a corresponding irregular recess within the basic form of the container, and is equipped with a narrowing, so that after two containers have been joined, such containers cannot be pulled or pushed apart laterally due to the presence of the narrowing or constriction. In this conjunction, the forms may extend over the entire height of the container, or only over part of the height, if need be, so that the protruding form is quasi inserted in a corresponding trough.

In another preferred embodiment, the basic form of the container consists of a regular polygon, preferably an equilateral triangle, an equally sided triangle, a rectangle, a square, a parallelogram, a rhombus, or a regular hexagon. Advantageous with such embodiments is the symmetry when the containers are positively plugged together in a manner covering the entire surface area. In this way, the imprint may lead to a great number of different patterns or pictorial contents that can be combined in any desired way like endless images depending on the sequence in which the stack is assembled. Likewise, different esthetically appealing forms can be created depending on how the assembly is selected.

In a special embodiment, the container has at least partially a combined framing comprised of a groove and a spring, or similar means for joining two containers. By providing a groove and spring along at least part of the periphery it is possible to solidly connect the containers with one another as well. Especially if the container have the shape of polygons, such polygonal containers can be connected with one another in such a way that they can be imprinted without having to be kept together by an external frame, or it is possible also to hang a composite of two containers already assembled on the wall like a picture. So that the containers can be assembled with great ease, the edges or forms are designed slightly conically versus the corresponding surfaces, whereby the containers are additionally provided with edges at least along a lateral surface for setting it up, so that an individual container can be set up in a vertical position.

An opening with a lock sealing said opening is provided for filling the container. In a first embodiment, said opening is worked into a protruding form, whereby such an opening can be arranged, for example in a deeper disposed trough, and sealed by means of a stopper aligned flush with the form, so that the lock is disposed hidden in the surface of projection.

Alternatively, it is possible that in the sealed condition of the container, the lock and at least one plane surface of the container jointly form a common plane, and that the lock can be locked in a certain position, so that several containers can be arranged disposed next to one another, and a lock substantially assuming the contour of a form is accommodated in the corresponding contour. Furthermore, with a preferably flat form of the individual containers, it is assured that the containers are prevented from turning during transport, which would release the lock.

According to yet another further developed embodiment of the invention, the lock of the container assumes the function of at least one positively connecting connection element in order to provide the connection with another element in this way. Such an embodiment offers the further benefit that it causes the user of the containers to re-attach the lock again to the containers, which ensues the benefit that high-quality containers that are to be returned again to the manufacturer in the deposit process, are shipped back again to the distributor in the locked condition by causing the user to re-mount the lock. In this way, any perishable container contents are prevented from leaking from the container during shipping, and materials that can be recycled are returned into the production cycle, and refuse is avoided. In this connection, the lock may only have a surface-covering function, or as such assume an active function in the form of a tooth system or plug.

In a particularly preferred embodiment, the lock of the container has a clearly defined position in the locked condition, which preferably assembles at least one plane of the lock with at least one plane of the container to jointly form a common plane. This can be accomplished, for example by plugging the lock to an uncircular opening of the container. Another possibility for clearly defining the position of the lock in the locked position is the use of a thread with a stop, which assures that the surface comprised of a plurality of plugged-together containers is in fact plane. A lock with a clearly defined position in the locked condition or in a hidden arrangement may be designed as a screw, snap, or plug lock.

Several identical containers as defined by the invention preferably form a regular pattern at least in one direction, whereby the individual containers and/or individual locks may be manufactured from different or the same materials, e.g. such as glass, ceramic material, metal, a polymeric material, or from a composite material, or mixtures of such materials.

The container is preferably imprinted with images imprinted on or glued to it. It is particularly preferred that the container is imprinted with a cutout of a motif that may be glued to it as well, such cutout complementing at least one further cutout of a motif of another container as defined by the invention, so that a common motif is produced by assembling several containers.

To the extent to which the containers have been imprinted with a motif and/or pattern extending over a number of containers, the originally selected sorting sequence can be established again with the help of the random motif or pattern, so that the information already imprinted earlier can be recovered.

Such information can be used in this connection for quality assurance and later control purposes, or to determine a certain association, which may be an association depending either on time or an image, if necessary. A time-dependent association signals to the user that a constant quality of a charge of a production position is assured, and that in no case different qualities have been mixed together because different production charges were involved in a mix. If more far-reaching information has been imprinted on the containers, attractive colors or designs may be in the foreground, or such designs may be reproductions of natural objects or people that can be reassembled again like a mosaic after they were taken apart. Other examples are patterns, for example water marks or water mark imitations extending over a great number of different containers, or having individual hand marks.

Furthermore, by intimately combining the individual containers among one another, the latter can be advantageously imprinted fully automatically on a printing machine, or provided with labels, so that a rational production process is feasible because many containers can be imprinted simultaneously.

In addition to the purely technical application possibilities and benefits, it is possible also, e.g. to provide the containers with imprints in such a way that the content of the imprint becomes visible only when many containers of the same type have been connected with one another in the correct sequence covering the surface area. This offers the advantage that instructions can be read only if all containers are connected in the correct stacking sequence, which attracts the attention of some container users and/or satisfies their collection and complementation needs.

Furthermore, it is possible to provide several containers arranged next to one another with an imprint that is free of any joints owing to the composite structure, and, after the individual containers have been taken apart, permits later reconstruction of the pattern used that is true to the original.

According to a special and particularly preferred embodiment of the invention, the container is a bottle with a nominal volume of from 1 cl to 1000 cl, preferably from 1 cl to 100 cl, particularly preferably from 1 cl to 4 cl, whereby the bottle and/or the lock are provided with a motif cutout imprinted on or glued to it, which complements at least one other motif cutout of another container having the same or a different shape.

It is an important advantage of the container as defined by the invention that it makes available a surface on which one or more motifs or information or instructions can be imprinted on a large surface area. Examples of instructions that may be applied to packagings are notes of caution, or advertisements can be applied to a large surface area by far exceeding the space available on one single container. Motifs include, e.g. colors and images or reproductions of natural objects or people. Examples of notes or patterns include information documenting the stack row, or may be irregular patterns, water marks or water mark imitations extending over a great number of different bottles, or individual hand signs.

The invention is explained in detail again in the following with the help of the figures, in which.

Figure 1:
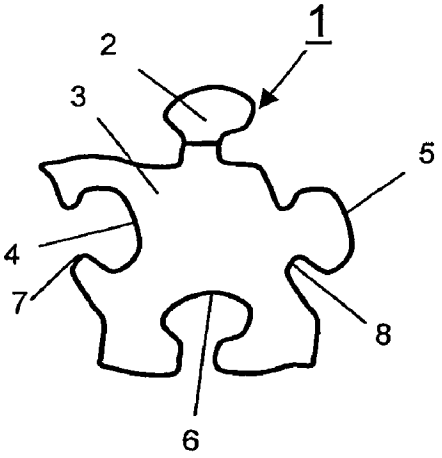
FIG. 1 is a top view of a container as defined by the invention.

FIG. 1 shows a container 1 as defined by the invention with a re-attachable lock, the latter and the surface 3 of the container 1 jointly forming a plane, which can be imprinted or receive an attachment glued to it. A concave form 4 positively receives a corresponding convex form 5, whereby the contour of a concave form 6 conforms to the contour of the re-attachable lock 2. FIG. 1 shows only the top view of the container 1. However, the container 1 has an elevation perpendicularly to the plane of the figures, which provides the container 1 with a 3-dimensional form with the preferred volume. For producing a composite comprised of a plurality of the containers 1, the concave form 4 is provided with the narrowing 7, and the convex form 5 is provided with the constriction 8, so that after the composite has been assembled, the individual containers 1 cannot readily drop from the composite.

Figure 2:
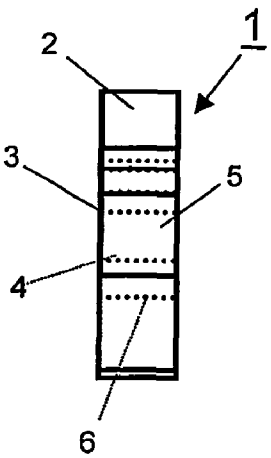
FIG. 2 is a side view of the container according to FIG. 1 as defined by the invention.

FIG. 2 shows a side view of a container 1 as defined by the invention according to FIG. 1, with the concave form 4.

Figure 3:
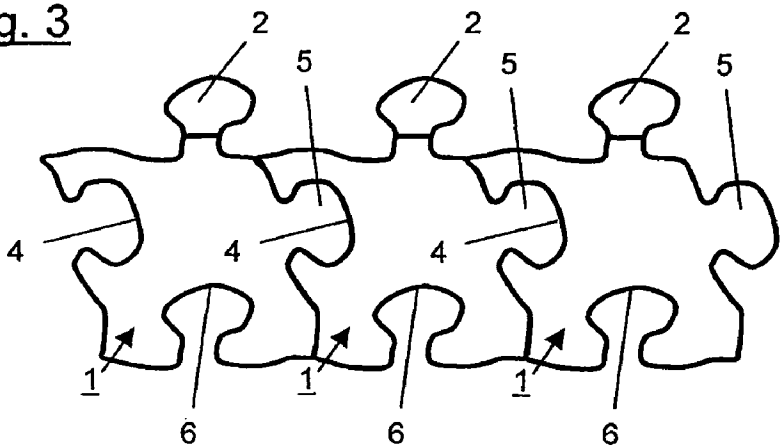
FIG. 3 is a top view of three assembled containers according to FIG. 1.

FIG. 3 shows a one-dimensional composite comprised of three containers 1, which are connected with one another in a row with the help of the concave form 4 and the convex form 5 shown in FIG. 1.

Figure 4:
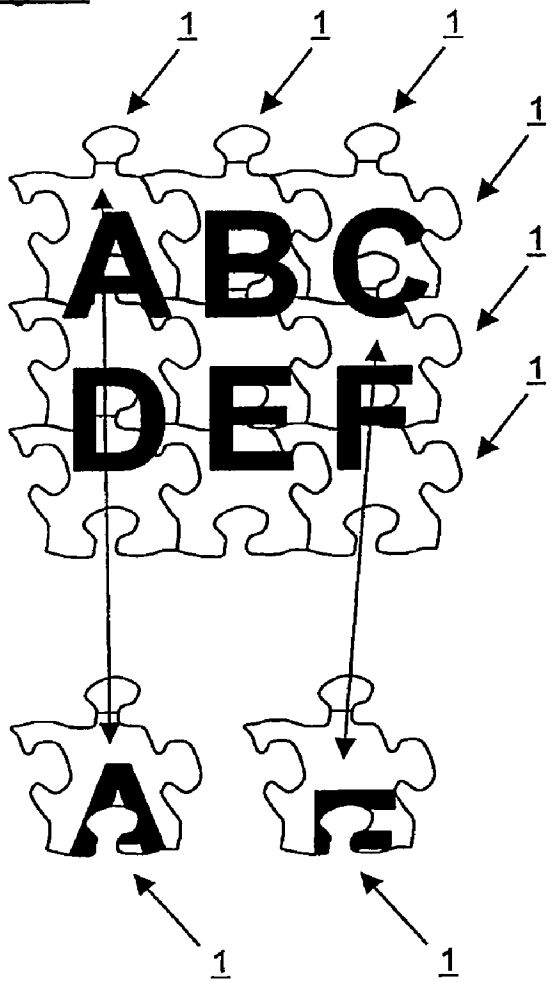
FIG. 4 is a top view of a composite comprised of nine assembled containers having the same shape and provided with a text imprint that can be read only on the composite structure with the correct composite sequence, as well as of two individual containers from the composite.

FIG. 4 shows a two-dimensional composite with a nearly square translation symmetry on which a text is imprinted, which cancels the symmetry of the composite, on the one hand, and is readable only with a coded imprint after the containers 1 have been correctly plugged one into another as defined by the invention. Raised are two containers 1 as defined by the invention with a coded imprint originating from the $1^{st}$ line and $1^{st}$ column and the $2^{nd}$ column and $3^{rd}$ column of the two-dimensional composite. The thickness of the coding was intentionally selected low in the figure for demonstration purposes.

Figure 5:
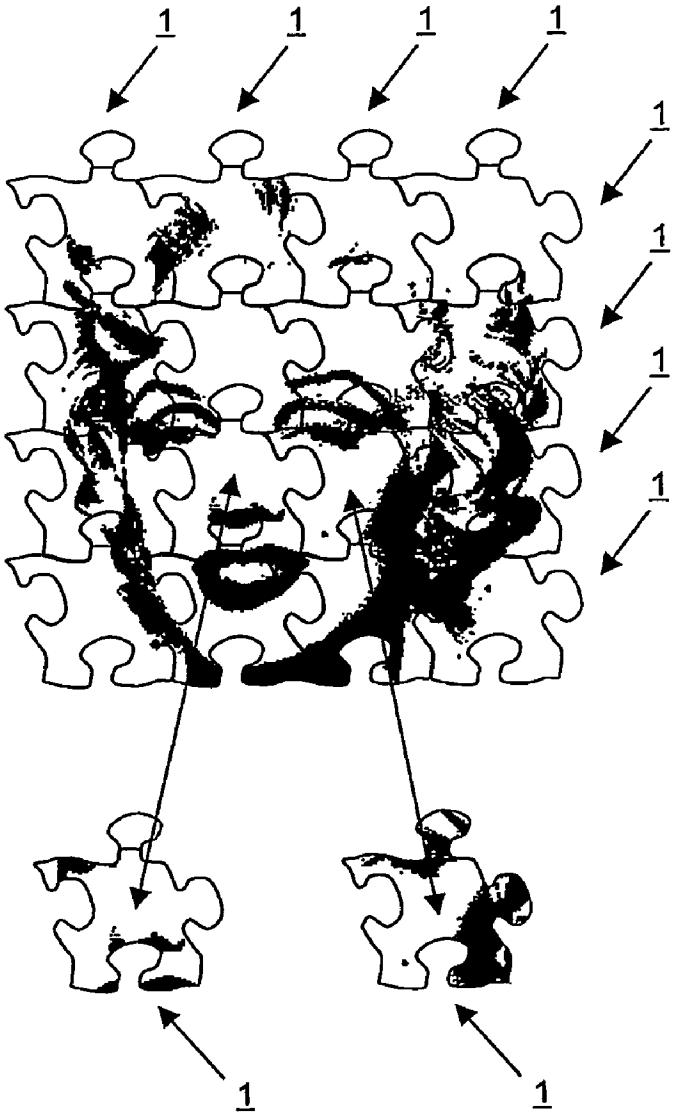
FIG. 5 is a top view of a composite comprised of sixteen containers, which shows an image after the composite has been correctly assembled.

FIG. 5 shows a composite comprised of sixteen containers 1 as defined by the invention, each showing a different imprint, whereby the different imprints jointly generate by their sequence a visible image. A correct stacking sequence is documented in this way. Raised are two containers 1 as defined by the invention from the $3^{rd}$ line and $2^{nd}$ column, as well as from the $3^{rd}$ line and $3^{rd}$ column of the composite, whereby the columns are counted from the left to the right, and the lines from the top to the bottom. The two raised containers are imprinted with a different motif imprint of the common motif in FIG. 4, whereby the two different motif cutouts of the two differently imprinted containers 1 complement one another. The first container shows a motif cutout with parts of the upper lip, nose and the right eye, whereas the second container shows parts of the left eye and the left cheek of a randomly selected imprint motif. The motif cutout can be only clearly recognized in the correct composite in FIG. 4, and thus documents the correct tacking sequence.

Figure 7:
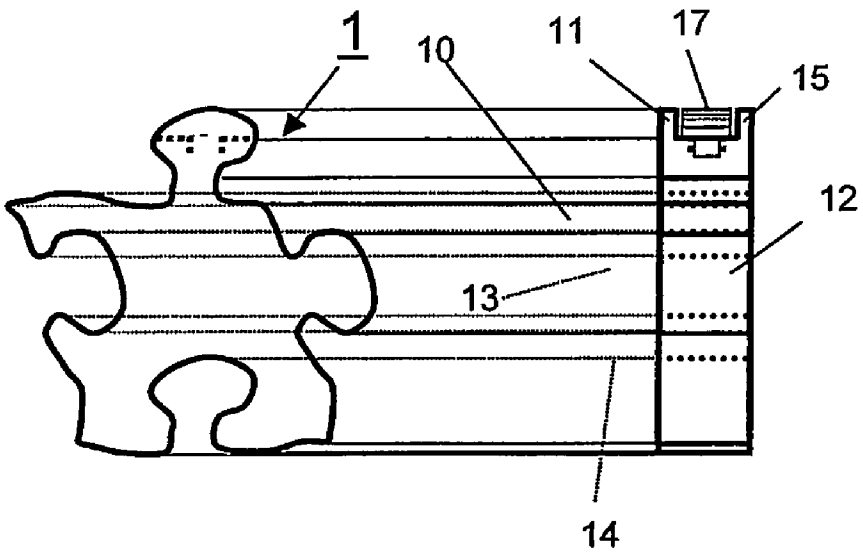
FIG. 7 is a top and side view of the container according to FIG. 1.
Figure 6:
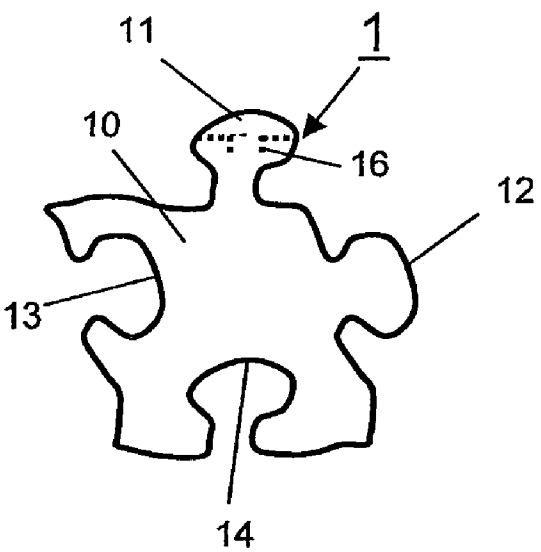
FIG. 6 is a top view of a container as defined by the invention, with a hidden lock.

FIG. 6 is a top view and FIG. 7 is a top and side view of a container 10 as defined by the invention, which has an outer contour that is identical to the greatest possible extent with the container 1 as defined by the invention in FIG. 1. To that extent, said container has the outwardly projecting concave forms 11, 12, as well as the concave forms 13, 14 projecting into the basic body of the container 10. Instead of a screw lock, a groove or trough 15 is formed in the upper form 11, feeding into a bore 16 for filling the container 10. The bore 16 is sealed by a stopper 17, which does not project beyond the edge of the trough 15 and thus terminates the latter positively in accordance with the form 11 along its edge. The stopper 17 may be retained in the bore 16, e.g. by means of a bayonet fixing or clamping closure or a sealing lip in the bore 16, and can be pulled by force from the bore 16, so that the contents of the container 10 can be emptied. After the container 10 has been drained, it can be closed again with the stopper 17.

The embodiments represented in the figures are shown only by way of example, and serve for illustrating the invention without, however, limiting the idea of the invention. Particularly the form of the circumference of the example representing a piece of a puzzle selected in the figures, and the motif of the imprint according to the claims are freely variable and do not limit the idea of the invention. Furthermore, the imprint can be selected as desired as well.

LIST OF REFERENCE NUMBERS

1 Container
2 Lock
3 Surface
4 Form
5 Form
6 Form
7 Narrowing
8 Constriction
10 Container
11 Form
12 Form
13 Form
14 Form
15 Groove/trough
16 Bore
17 Stopper

I claim:

1. A container system comprising a plurality of containers assembled to form a two-dimensional composite having a positive connection between adjacent containers of said plurality of containers, each container of said plurality of containers being fillable with a liquid and comprising:

a lock;

at least one plane surface;

an irregular first form molded onto and projecting from a basic form of said container, said irregular first form having a first geometry comprising a first constriction;

an irregular second form molded onto and projecting from said basic form of said container, said irregular second form having a second geometry comprising a second constriction;

an irregular third form projecting into said basic form of said container to form a first recess comprising a first narrowing, said irregular third form having a third geometry corresponding to said first geometry of said first irregular form;

wherein at least one of said irregular first form, said irregular second form, said irregular third form and said irregular fourth form is provided with a bore and a stopper sealing said bore, wherein said bore is arranged in a trough formed in said at least one of said irregular first form, said irregular second form, said irregular third form and said irregular fourth form an irregular fourth form projecting into said basic form of said container to form a second recess comprising a second narrowing, said irregular fourth form having a fourth geometry corresponding to said second geometry of said second irregular form;

wherein said first geometry of said first irregular form is different from said second geometry of said second irregular form and said third geometry of said third irregular form is different from said fourth geometry of said fourth irregular form;

wherein in order to connect said container to a first adjacent container of said plurality of containers, said irregular first form of said container engages the irregular third form of said first adjacent container and extends into the plane surface of said first adjacent container; and wherein in order to connect said container to a second adjacent container of said plurality of containers, said irregular second form of said container engages the irregular fourth form of said second adjacent container and extends into the plane surface of said second adjacent container.

2. The container system according to claim 1, wherein said container is positively connected with said first adjacent container and said second adjacent container.

3. The container system according to claim 1, wherein said container positively connected with said first adjacent container and said second adjacent container jointly forms with said first adjacent container and said second adjacent container a regular pattern.

4. The container system according to claim 1, wherein said container positively connected with said first adjacent container and said second adjacent container having a same shape, forms a closed plane surface jointly with said first adjacent container and said second adjacent container.

5. The container system according to claim 1, wherein a shape of said container conforms to a piece of a puzzle.

6. The container system according to claim 1, wherein said container has two parallel surfaces, whereby one surface is provided for laying and at least one surface for imprinting.

7. The container system according to claim 1, wherein each of said irregular first form, said irregular second form, said irregular third form and said irregular fourth form extend over at least a part of a depth of said container.

8. The container system according to claim 1, wherein said basic form of said container describes a regular polygon.

9. The container system according to claim 1, wherein said container further comprises a groove along at least part of a periphery of said container.

10. The container system according to claim 1, wherein said stopper is uncovered by a surface of said at least one of said irregular first form, said irregular second form, said irregular third form and said irregular fourth form.

11. The container system according to claim 1, wherein said bore is sealable by an elastic stopper terminating flush with said at least one of said irregular first form, said irregular second form, said irregular third form and said irregular fourth form.

12. The container system according to claim 1, wherein with said lock in a locking condition, at least one plane surface of said lock and at least one plane surface of said container jointly form a common plane, and that said lock of said container assumes a function of at least one positive connection element for adjoining other containers fitting said container.

13. The container system according to claim 1, wherein said lock of said container forms a tooth system or plug element or a form of said container, and that in a locking condition, said lock of said container is in a clearly defined position.

14. The container system according to claim 1, wherein said lock is a screw, snap or plug lock.

15. The container system according to claim 1, wherein a shape of said container positively interconnected with said first adjacent container and said second adjacent container forms a symmetrical pattern at least in one direction.

16. The container system according to claim 1, wherein at least one of said container and said lock comprise a material selected from glass, ceramic material, metal, a polymeric material and a composite material.

17. The container system according to claim 1, wherein at least one of said container and said lock are imprinted or provided with elements glued thereto, in a manner such that several containers of said plurality of containers can be assembled to form one common motif.

18. The container system according to claim 1, wherein at least one of said container and said lock is provided with a cutout of a motif imprinted thereon or glued thereto, said cutout of a motif complementing at least one further cutout of a motif of another container.

19. The container system according to claim 1, wherein said container has a nominal volume of 1 cl to 1,000 cl.

20. The container system according to claim 1, wherein said container is a bottle.

21. The container system according to claim 19, wherein said container has a nominal volume of 1 cl to 100 cl.

22. The container system according to claim 21, wherein said container has a nominal volume of 1 cl to 4 cl.

* * * * *

UNITED STATES PATENT AND TRADEMARK OFFICE

CERTIFICATE OF CORRECTION

PATENT NO. : 7,963,411 B2
APPLICATION NO. : 10/566609
DATED : June 21, 2011
INVENTOR(S) : Nölle It is certified that error appears in the above-identified patent and that said Letters Patent is hereby corrected as shown below:

In Column 8, lines 32-38, (Lines 20-26 of Claim 1), please delete the following paragraph: "wherein at least one of said irregular first form, said irregular second form, said irregular third form and said irregular fourth form is provided with a bore and a stopper sealing said bore, wherein said bore is arranged in a trough formed in said at least one of said irregular first form, said irregular second form, said irregular third form and said irregular fourth form".

In Column 8, between lines 43 and 44, (Lines 31 and 32 of Claim 1) after the word "form;" please insert the following paragraph:
--wherein at least one of said irregular first form, said irregular second form, said irregular third form and said irregular fourth form is provided with a bore and a stopper sealing said bore, wherein said bore is arranged in a trough formed in said at least one of said irregular first form, said irregular second form, said irregular third form and said irregular fourth form--.

Signed and Sealed this
Twenty-sixth Day of July, 2011

David J. Kappos

David J. Kappos
*Director of the United States Patent and Trademark Office*